US005427465A

United States Patent [19]

Sato

[11] Patent Number: 5,427,465

[45] Date of Patent: Jun. 27, 1995

[54] CLAMP FITMENT FOR CONNECTING PIPE SECTIONS

[76] Inventor: Masataro Sato, 191-banchi, Ooaza Ikenobe, Miki-cho, Kita-gun, Kagawa-ken, Japan

[21] Appl. No.: 109,068

[22] Filed: Aug. 19, 1993

[30] Foreign Application Priority Data

Sep. 25, 1992 [JP] Japan ..... 4-256800

[51] Int. Cl.[6] ..... E04G 7/00; B25G 3/36

[52] U.S. Cl. ..... 403/49; 403/385; 403/394

[58] Field of Search ..... 403/385, 388, 394, 384, 403/49, 164, 323, 322; 285/188

[56] References Cited

U.S. PATENT DOCUMENTS

| | | | |
|---|---|---|---|
| 1,706,215 | 3/1929 | Davidson . | |
| 1,706,801 | 3/1929 | Merrill | 403/385 |
| 1,834,838 | 12/1931 | Hingley | 403/385 |
| 2,945,713 | 7/1960 | Sears | 463/385 X |
| 4,443,128 | 4/1984 | Yamamoto et al. | 403/385 |
| 4,826,079 | 5/1989 | Przystawik | 403/49 X |
| 5,167,466 | 12/1992 | Hsieh | 403/385 |

FOREIGN PATENT DOCUMENTS

| | | | |
|---|---|---|---|
| 1103392 | 11/1955 | France . | |
| 2713669 | 8/1978 | Germany . | |
| 383451 | 11/1932 | United Kingdom | 403/385 |

*Primary Examiner*—Edward K. Look
*Assistant Examiner*—Hoang Nguyen
*Attorney, Agent, or Firm*—Armstrong, Westerman, Hattori, McLeland & Naughton

[57] ABSTRACT

A clamp fitment includes a pair of holding members each capable of clamping a pipe section, a coupler mounted between both the holding members for relatively rotatably but unseparatably coupling the holding members, and a lock mechanism mounted between both the holding members for restraining the relative rotation of the holding members at any time in positions in which the pipe sections clamped in the holding members intersect each other at right angles. The single clamp fitment for connecting the pipe sections can be used properly as either of "swivel type" in which the angle of intersection of the pipe sections can be freely selected and "orthogonal type" for unifying the pipe sections in a square fashion. This eliminates the need for a worker to carry two kinds of clamp fitments to a working field, leading to simplified handling and management of the clamp fitment.

12 Claims, 10 Drawing Sheets

CLAMP FITMENT FOR CONNECTING PIPE SECTIONS

BACKGROUND OF THE INVENTION

1. Field of the Invention

The present invention relates to a clamp fitment used for interconnecting pipe sections when a scaffolding framework in a building field or the like is to be framed by a plurality of pipe sections.

2. Description of the Prior Art

Conventional clamp fitments of the type described above include, for example, a so-called "swivel type" clamp fitment designed to relatively rotatably and unseparatably couple a pair of holding members $H_1$ and $H_2$ capable of clamping pipe sections $P_1$ and $P_2$, so that the angle of intersection of the pipe sections $P_1$ and $P_2$ clamped by the holding members $H_1$ and $H_2$ can be freely selected, as shown in FIG. 9; and a so-called "orthogonal or square type" clamp fitment designed to integrally couple a pair of holding members $H_1$ and $H_2$ by a plurality of rivets or the like at positions in which the pipe sections $P_1$ and $P_2$ clamped into the holding members $H_1$ and $H_2$ intersect each other at right angles, so that the angle of intersection of the pipe sections $P_1$ and $P_2$ is fixed at right angles.

The "swivel type" clamp fitment is effective when a pair of pipe sections are interconnected obliquely at arbitrary intersection angle, while the "orthogonal type" clamp fitment is effective when a pair of pipe sections are strongly interconnected orthogonaly. In an actual building field, however, different types of clamp fitments must be used depending upon sites of a scaffolding framework and for this reason, it is a conventional practice for workers to carry both the types of clamp fitments, and use those fitments properly as required, resulting in troublesome handling and management.

SUMMARY OF THE INVENTION

Accordingly, it is an object of the present invention to provide a clamp fitment for connecting pipe sections, wherein a common single clamp fitment can be used as both of "the swivel type" and "the orthogonal type", thereby overcoming the above-described problem associated with the prior art.

To achieve the above object, according to the present invention, there is provided a clamp fitment for connecting pipe sections, comprising a pair of holding members each capable of clamping a pipe section, a coupler mounted between both the holding members for relatively rotatably but unseparatably coupling the holding members, and a lock mechanism mounted between both the holding members for restraining the relative rotation of the holding members at any time in positions in which the pipe sections to be clamped in the holding members intersect each other at right angles.

With the above arrangement, the clamp fitment can be used as a so-called "orthogonal type" in which the holding members are unified in positions in which the pipe sections intersect each other at right angles in a locking state of the lock mechanism, and as a so-called "swivel type" in which the holding members are connected relatively rotatably in an unlocking state of the lock mechanism. Therefore, the single clamp fitment can be used properly as any of "the orthogonal type" and "the swivel type". This eliminates the need for the workers to carry two types of clamp fitments to a working field, leading to strikingly simplified handling and management of the clamp fitment. Moreover, the manufacture of only a single type of a clamp fitment suffices, which contributes to a corresponding reduction in manufacture cost.

The above and other objects, features and advantages of the invention will become apparent from the following description of preferred embodiments, taken in conjunction with the accompanying drawings.

DESCRIPTION OF THE PREFERRED EMBODIMENTS

Figure 2:
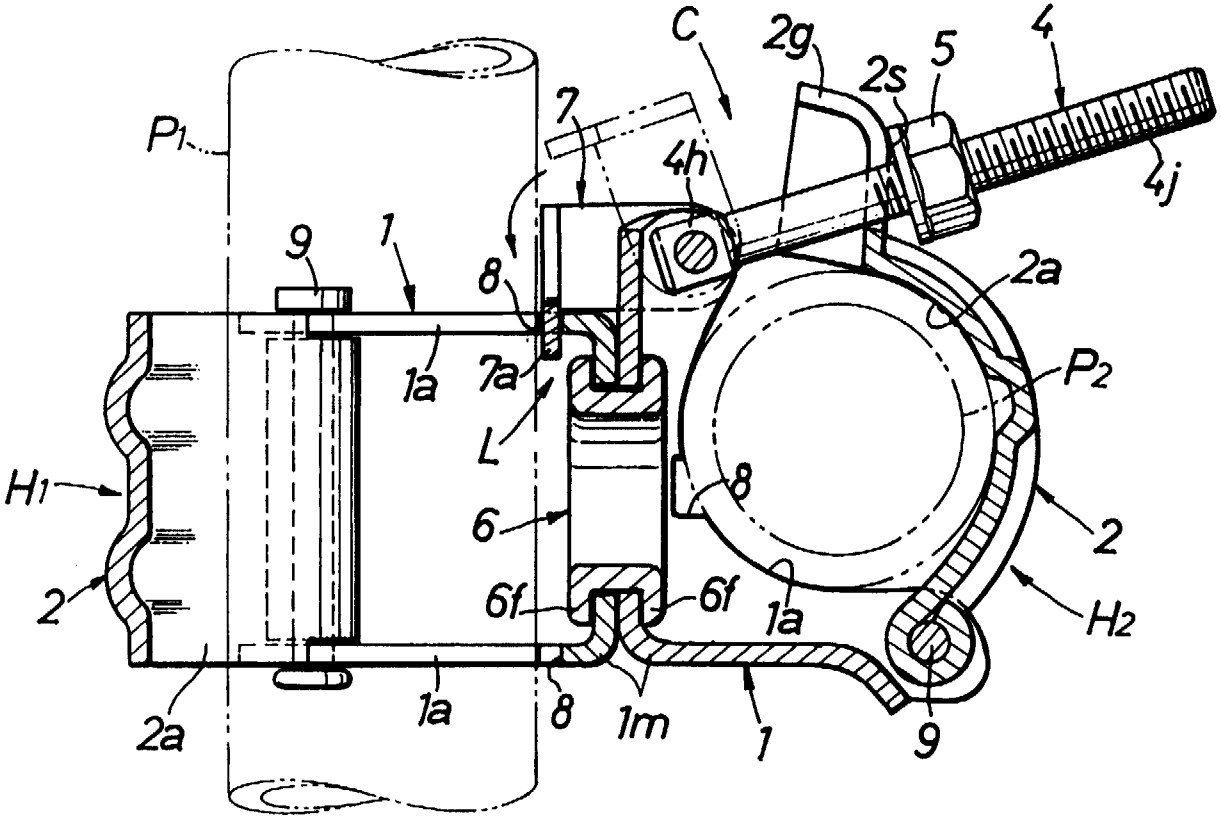
FIG. 2 is a sectional view taken along a line 2—2 in FIG. 1.
Figure 3:
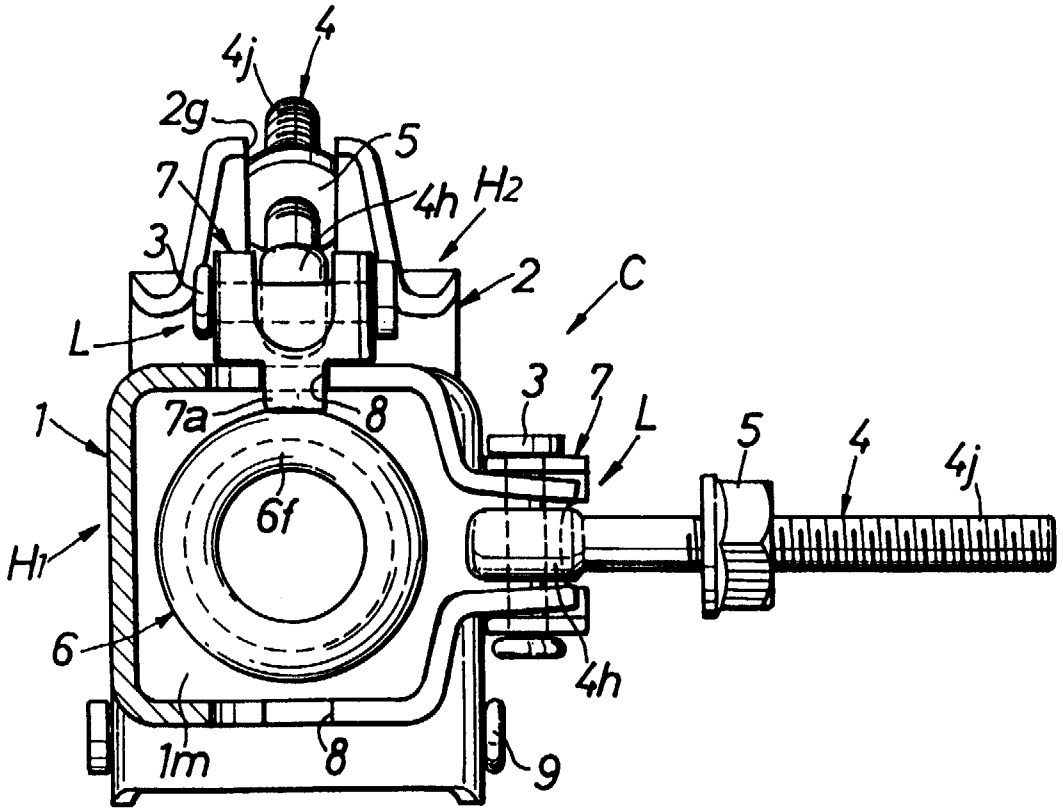
FIG. 3 is a sectional view taken along a line 3—3 in FIG. 1.

A first embodiment of the invention will now be described in connection with FIGS. 1 to 3. A clamp fitment C for interconnecting a pair of pipe sections $P_1$ and $P_2$ intersecting each other to form a scaffolding framework is comprised of first and second holding members $H_1$ and $H_2$ capable of clamping the pipe sections $P_1$ and $P_2$, respectively.

The first holding member $H_1$ includes a base frame 1 having an arcuate receiving surface 1*a* which is capable of abutting against an outer peripheral surface of the first pipe section $P_1$, and a tip frame 2 pivotally supported by a pin 9 at one end of the base frame 1 for swinging movement for opening and closing. The tip frame 2 is formed with an arcuate pressing surface 2*a* for clamping and fixing the first pipe section $P_1$ by cooperation with the receiving surface 1*a* of the base frame 1. A supporting frame portion 1*b* having a substantially U-shaped cross section is integrally provided at the other end of the base frame 1 to project therefrom. A support stub 3 is laterally spanned between a pair of opposed sidewalls of the supporting frame portion 1*b*, and an eyeball-like head 4*h* of a bolt a is rotatably supported in a fitted manner by the support stub 3. At a free end of the tip frame 2, there are formed a cutout portion 2*g* into which a threaded shank 4*j* of the bolt 4 can be fitted, and a receiving seat 2*s* for receiving a nut 5 threadedly engaged over the threaded shank 4*j* on opposite sides of the cutout portion 2*g*. Thus, the first pipe section $P_1$ can be clamped between the receiving surface 1*a* and the pressing surface 2*a* by tightening and pressing the nut 5 against the receiving seat 2*s* in a condition in which the threaded shank 4*j* of the bolt 4 has been fitted into the cutout portion 2*g*.

The structure of the second holding member $H_2$ is basically the same as that of the first holding member $H_1$ and hence, the description thereof is omitted, but individual components thereof are designated by reference characters similar to those of the first holding member $H_1$.

A coupling structure between both the holding members $H_1$ and $H_2$ will be described below. Flat intermediate walls 1*m* of the base frames 1 of the holding members $H_1$ and $H_2$ are placed on each other and interconnected for rotation about an axis perpendicular to axes of the pipe sections $P_1$ and $P_2$ by a cylindrical coupler 6 penetrating the intermediate walls 1*m*. The coupler 6 is integrally provided at opposite ends thereof with slip-out preventing outward-directed flange portions 6*f* each adapted to engage an inner surface of the intermediate wall 1*m* of the corresponding base frame 1. This ensures that both the base frames 1 cannot be separated from each other in an axial direction of the coupler 6.

The above-described structure is similar to that of the conventionally known "swivel type" clamp fitment, but according to the invention, two sets of lock mechanisms L, L are added for restraining the relative rotation of the holding members $H_1$ and $H_2$ in a position of intersection of the pair of pipe sections $P_1$ and $P_2$ at any time. Each of the lock mechanisms L is comprised of a frame type fastening 7 having a substantially U-shaped cross section and rotatably supported on the supporting frame portion 1*b* of one of the base frames 1 through the support stub 3, and a notch-like engage recess 8 provided in the arcuate receiving surface 1*a* of the other base frame 1, such that a locking piece 7*a* integrally and projectingly provided at a free end of the fastening 7 can be engaged into and disengaged from the engage recess 8.

The fastening 7 is movable between an engaged position (shown by a solid line in FIG. 2) in which the locking piece 7*a* is engaged into the engage recess 8, and a disengaged position (shown by a dashed line in FIG. 2) in which the engagement of the locking piece 7*a* is released. If the fastening 7 is turned from the disengaged position to the engaged position, particularly in a condition in which the pipe sections $P_1$ and $P_2$ are not mounted to the holding members $H_1$ and $H_2$, and center axes of the arcuate receiving surfaces 1*a* of the holding members $H_1$ and $H_2$ are perpendicular to each other, the holding members $H_1$ and $H_2$ are prevented from being rotated by the engagement between the locking piece 7*a* and the engage recess 8. Therefore, the clamp fitment C serves as "orthogonal type".

Figure 1:
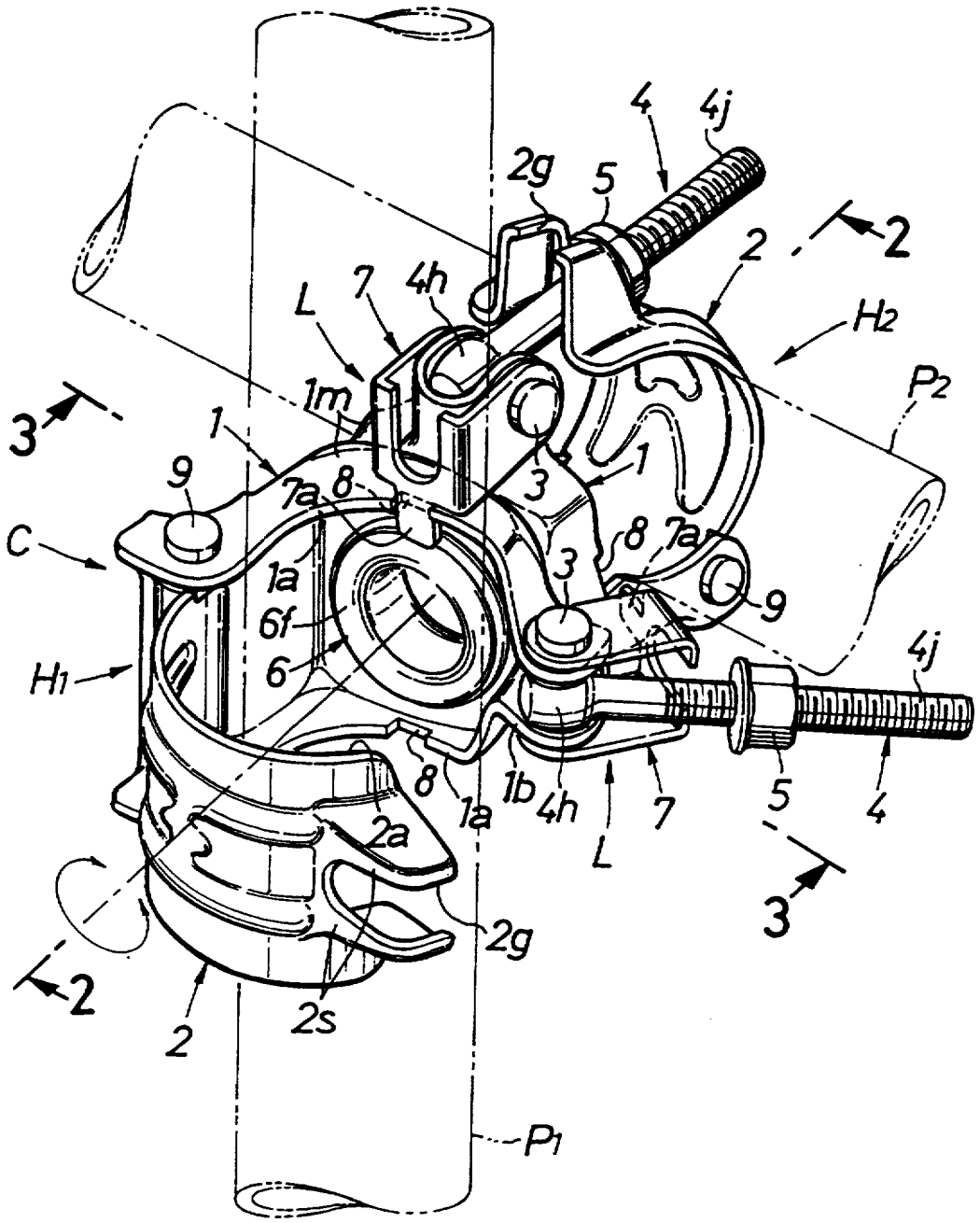
FIG. 1 is a perspective view of the entire construction of a clamp fitment according to a first embodiment of the present invention.

A pair of the engage recesses 8 are disposed in opposed locations on the arcuate receiving surface 1*a* of the base frame 1 on opposite sides of the axis of the coupler 6, and hence, even in positions of the holding members $H_1$ and $H_2$ rotated further through 180 degree from their states shown in FIG. 1, the locking piece 7*a* of each fastening 7 can be brought into engagement with the other engage recess 8 to prevent the holding members $H_1$ and $H_2$ from being rotated. Even by this arrangement, the clamp fitment C serves as "orthogonal type".

The operation of this embodiment will be described below. If the clamp fitment C is used as "swivel type", it is only necessary to place each of the fastenings 7 at the above-described disengaged position. This ensures that the holding members $H_1$ and $H_2$ are rotatable about the coupler 6, and only by clamping the pipe sections $P_1$ and $P_2$ to the holding members $H_1$ and $H_2$, the pipe sections $P_1$ and $P_2$ can be interconnected at any desired intersection angle.

On the other hand, if the clamp fitment C is used as "orthogonal type", the holding members $H_1$ and $H_2$ are placed at positions of intersection of the center axes of their arcuate receiving surfaces 1*a*, before the pipe sections $P_1$ and $P_2$ are clamped. In this condition, the fastening 7 is turned from the disengaged position to the engaged position, so that the locking piece 7*a* of the fastening 7 is engaged into corresponding one of the engage recesses 8. Thereafter, if the pipe sections $P_1$ and $P_2$ are clamped into the holding members $H_1$ and $H_2$, the outer peripheral surfaces of the pipe sections $P_1$ and $P_2$ are closely opposed to the outer surfaces of the corresponding locking pieces 7*a*, so that each of the pipe sections $P_1$ and $P_2$ serves to prevent rotation of the locking piece 7*a* in its disengaging direction. Thus, as long as the pipe sections $P_1$ and $P_2$ are clamped in the holding members $H_1$ and $H_2$, the engaged state between the locking piece 7*a* and the engage recess 8 can reliably be maintained by the pipe sections $P_1$ and $P_2$ themselves.

In this manner, the relative rotation of the holding members $H_1$ and $H_2$ is reliably restrained in the position in which the pipe sections $P_1$ and $P_2$ intersect each other at right angles and therefore, the clamp fitment C serves as "orthogonal type", so that the pair of pipe sections $P_1$ and $P_2$ can be integrally coupled to each other in their square states.

Moreover, in such a service mode of "orthogonal type", the holding members $H_1$ and $H_2$ are coupled to each other not only through the coupler 6 but also through the two fastenings 7 and hence, the breaking strength of the clamp fitment C is correspondingly increased. Even if the fastening 7 should be broken by the action of an excessive shear load between the holding members $H_1$ and $H_2$ as a result of the pipe sections $P_1$ and $P_2$ being twisted strongly in use, the holding members $H_1$ and $H_2$ are still in their rotatably connected states through the coupler 6. Therefore, as in the conventional "swivel type" clamp fitment, there is no fear that the pipe sections $P_1$ and $P_2$ are separated from each other.

The single clamp fitment C can be used properly as either of "swivel type" and "orthogonal type" and therefore, the need for the workers to carry two kinds of clamp fitments to a working field in order to frame a scaffolding framework is eliminated, leading to an improved handling of the clamp fitment or the like.

Figure 4:
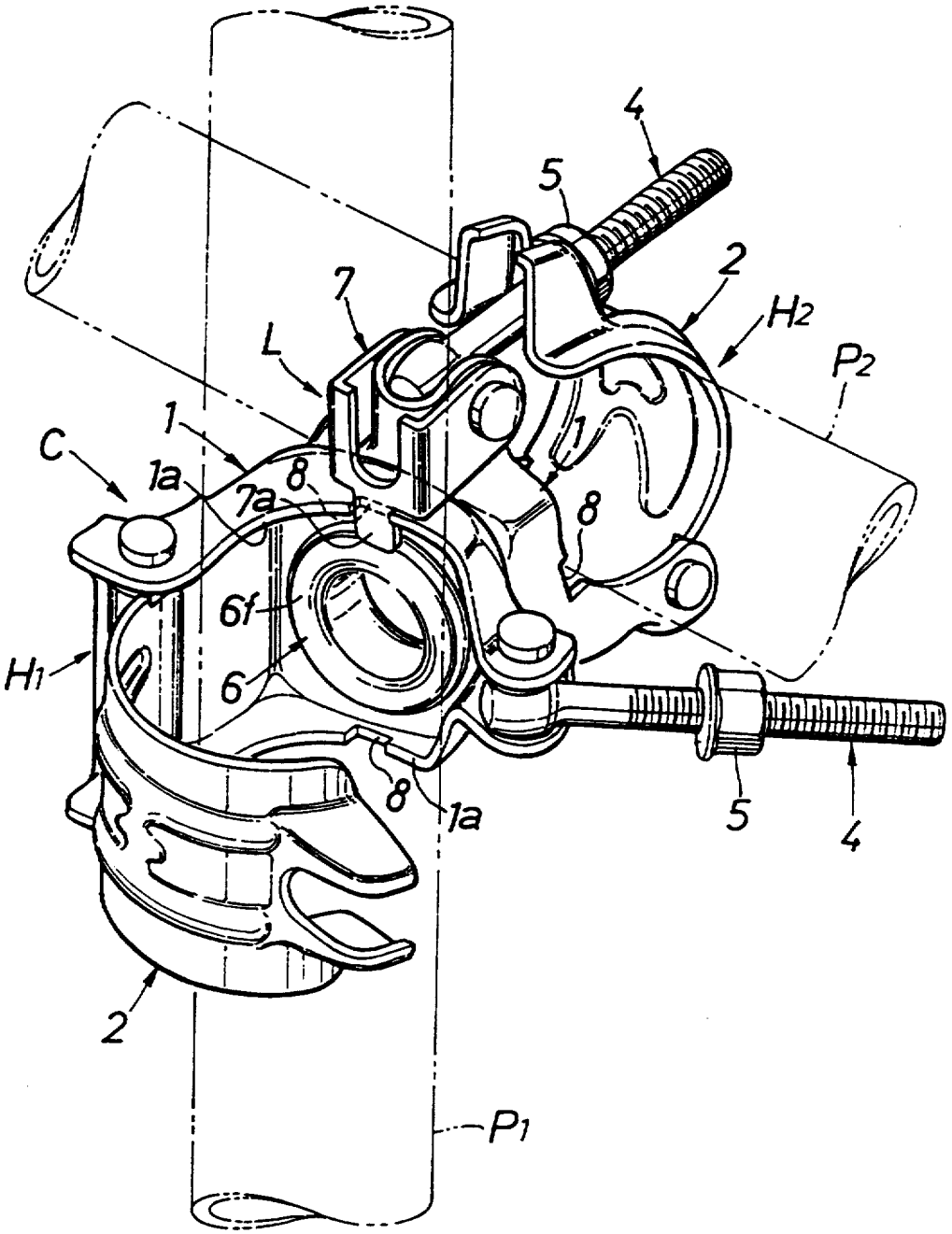
FIG. 4 is a perspective view of the entire construction of a clamp fitment according to a second embodiment of the invention.

A second embodiment of the invention is shown in FIG. 4. This embodiment is different from the previously described embodiment only in that a fastening 7 is mounted only on one holding member $H_2$ and no fastening is mounted on the other holding member $H_1$.

Figure 5:
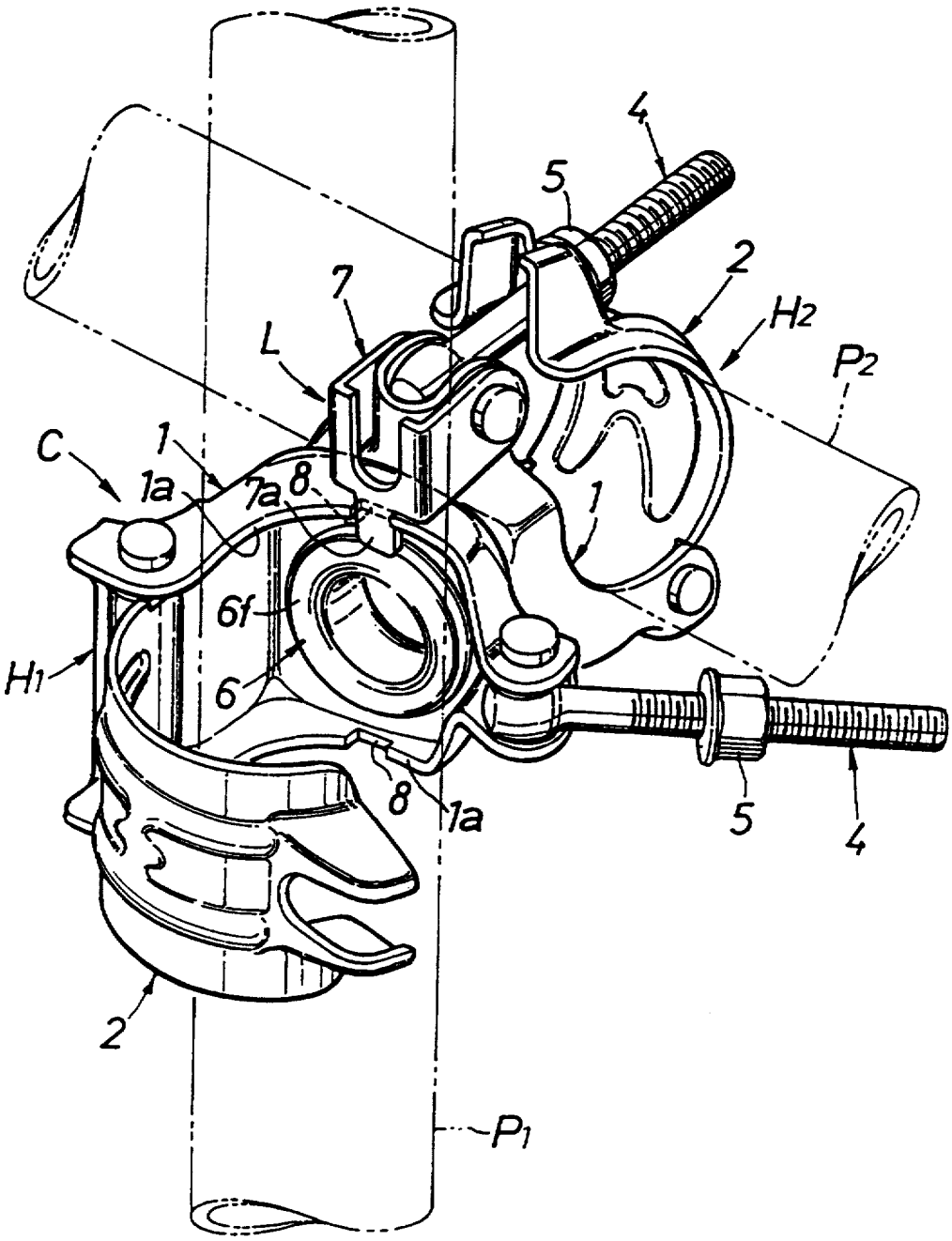
FIG. 5 is a perspective view of the entire construction of a clamp fitment according to a third embodiment of the invention.

Further, a third embodiment of the invention is shown in FIG. 5. This embodiment is different from the second embodiment only in that the engage recess 8 is omitted from the holding member $H_2$ having the fastening 7 mounted thereon.

Figure 6:
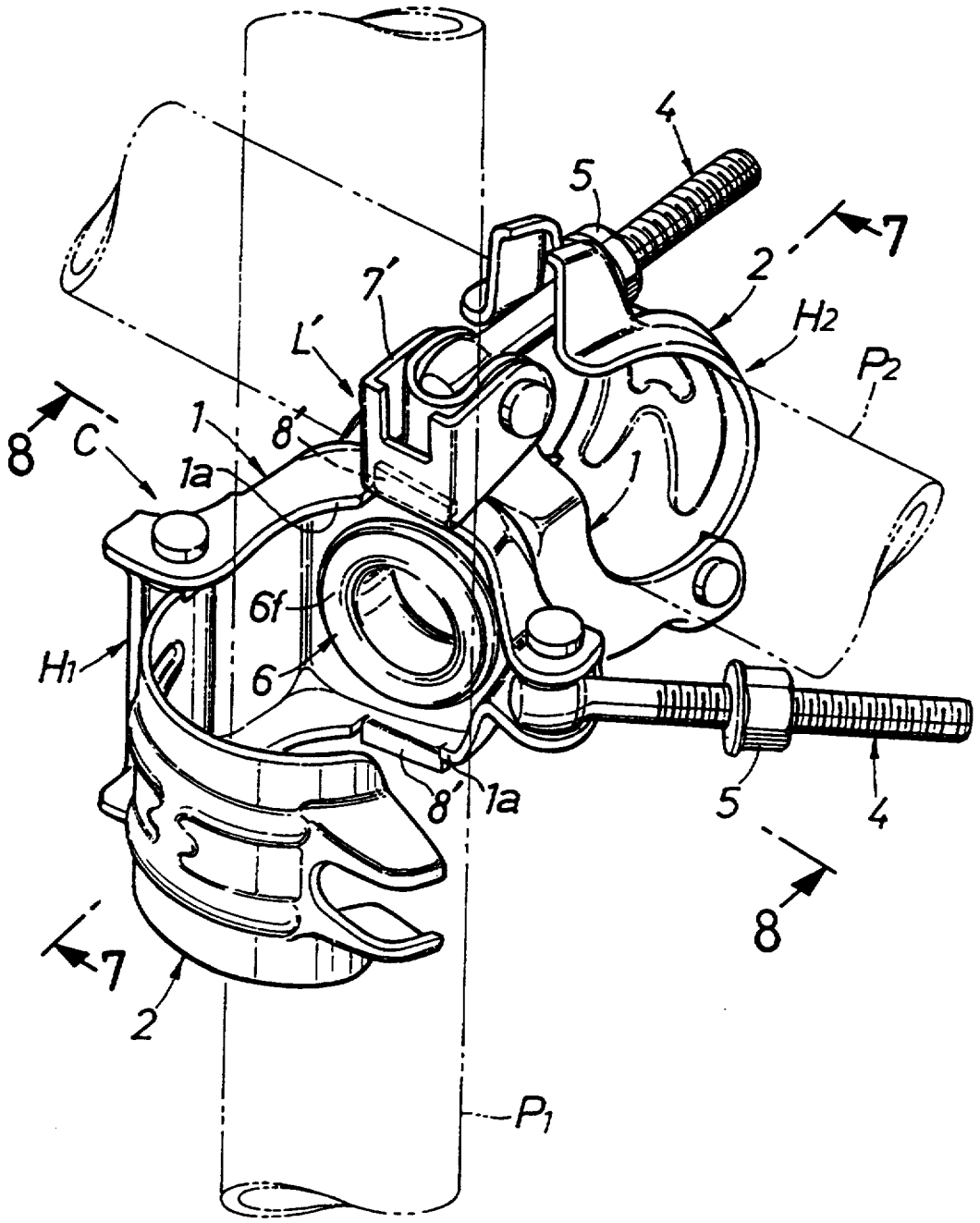
FIG. 6 is a perspective view of the entire construction of a clamp fitment according to a fourth embodiment of the invention.
Figure 7:
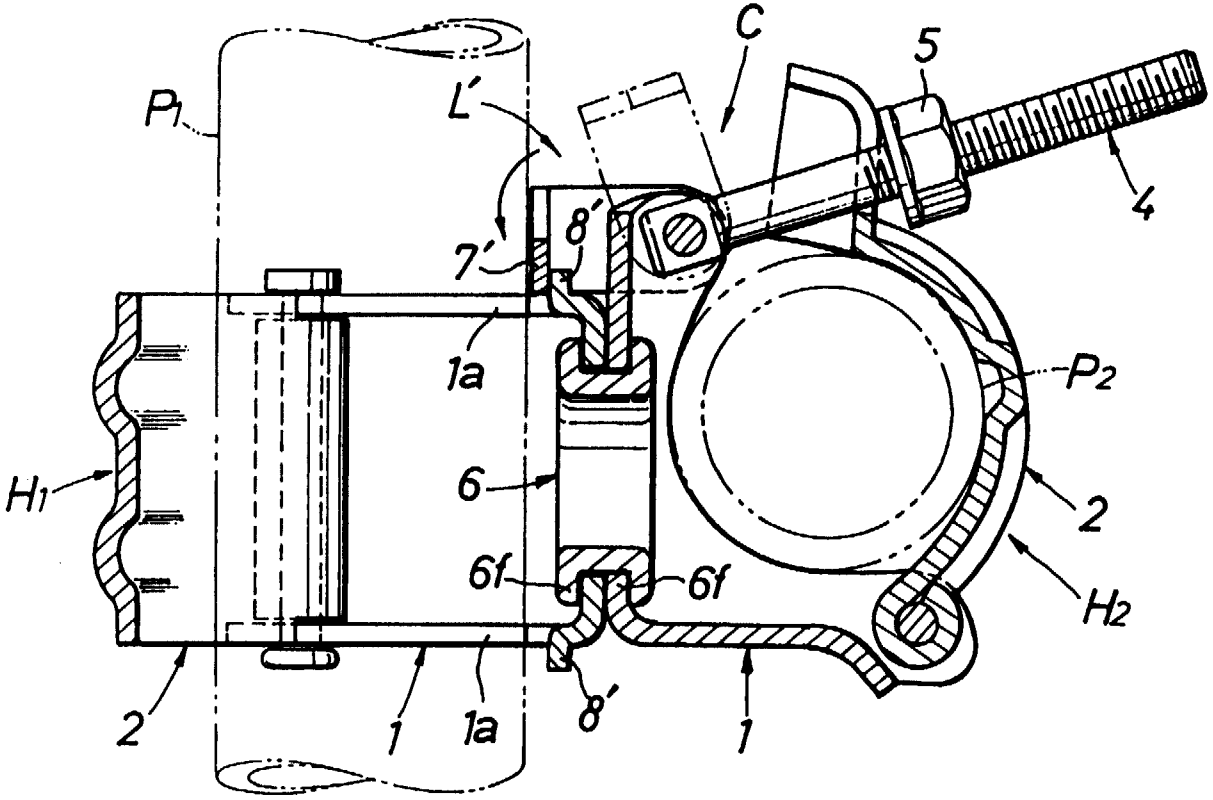
FIG. 7 is a sectional view taken along a line 7—7 in FIG. 6.
Figure 8:
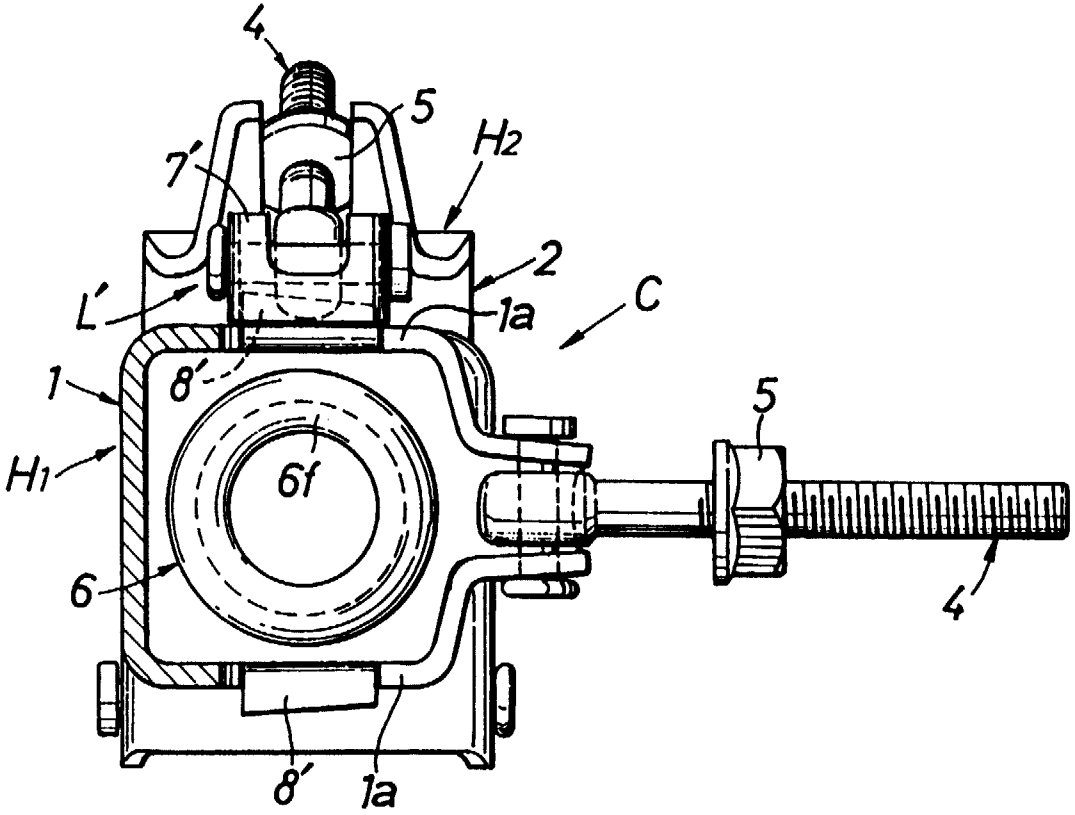
FIG. 8 is a sectional view taken along a line 8—8 in FIG. 6.
Figure 9:
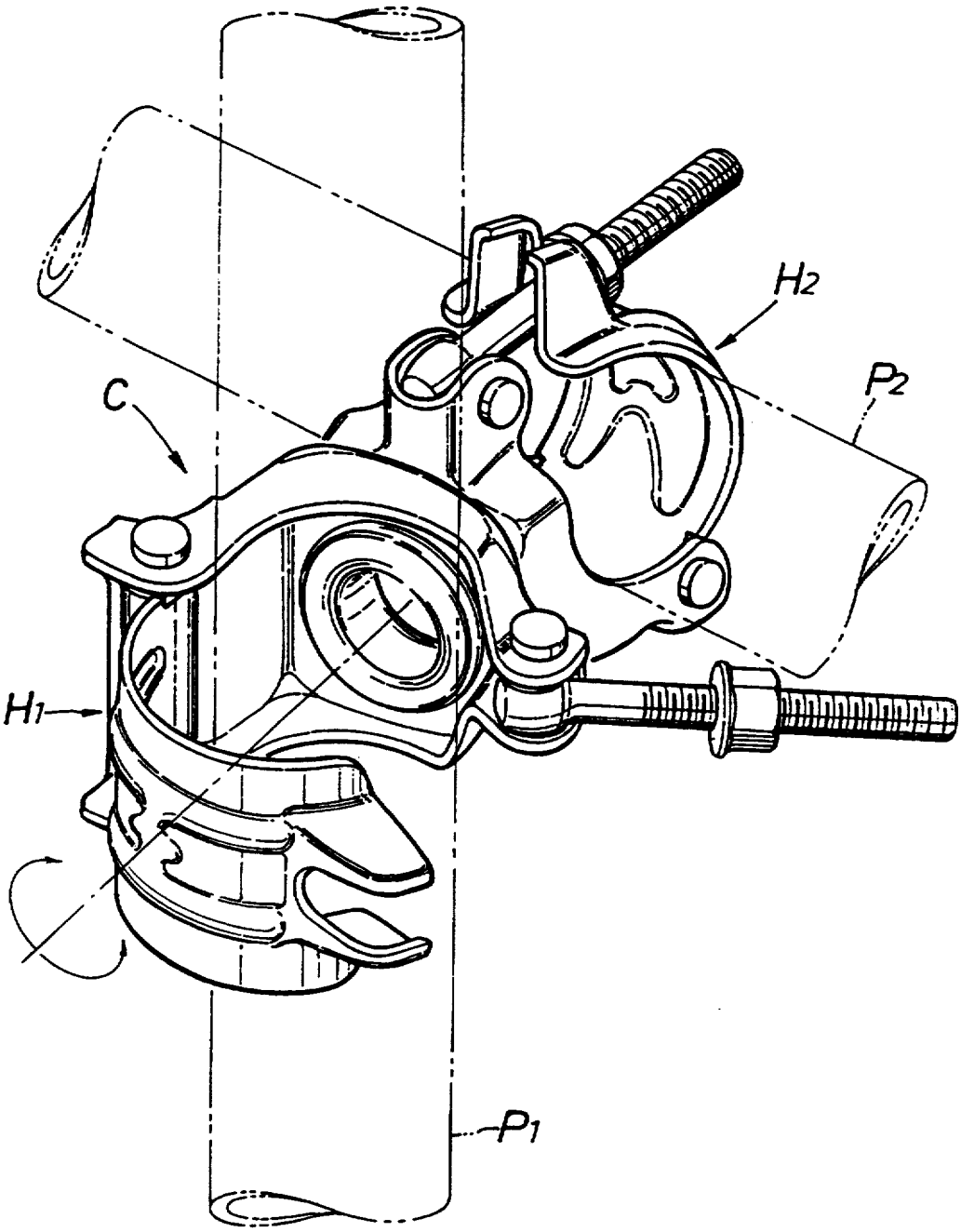
FIG.9 PRIOR ART
FIG. 9 is a perspective view of the entire construction of a prior art swivel type clamp fitment.
Figure 10:
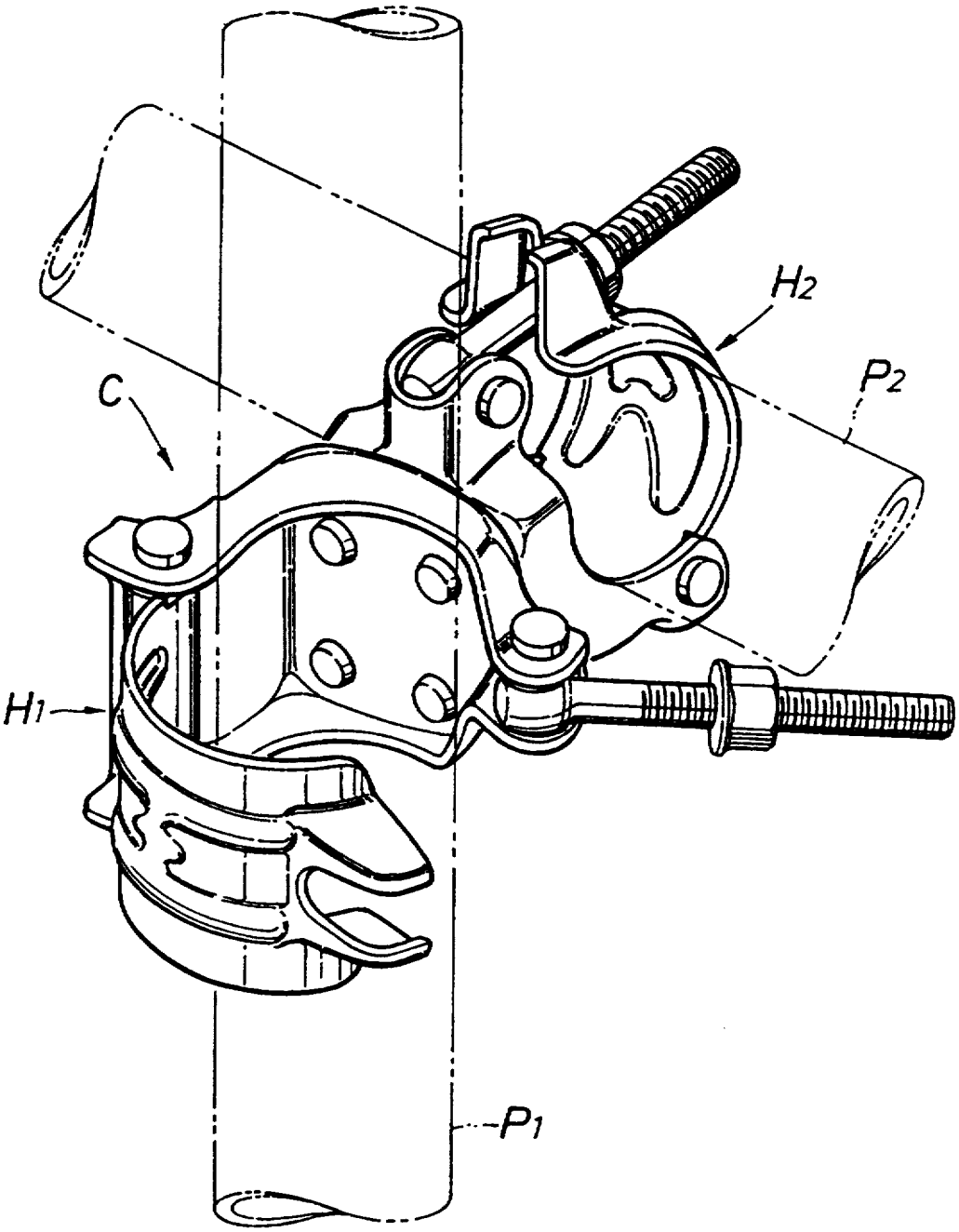
FIG.10 PRIOR ART
FIG. 10 is a perspective view of the entire construction of a prior art orthogonal type clamp fitment.

Yet further, a fourth embodiment of the invention is shown in FIGS. 6 to 8. This embodiment is different from the third embodiment only in respect of the structure of a lock mechanism. More specifically, in a lock mechanism L′ in the fourth embodiment, the locking piece 7*a* is not provided on a fastening 7′. In place of the locking piece 7a, a pair of locking projections 8' are integrally and projectingly provided on the arcuate receiving surface 1a of the other holding member $H_2$, and either on is capable of being brought into engagement with an inner surface of the fastening 7' to prevent the holding members $H_1$ and $H_2$ from being rotated. Each of the projections 8' is formed by cutting or notching two portions of the arcuate receiving surface 1a and bending a portion thereof between the two notched portions outwardly. Moreover, the locking projections 8' are disposed at opposed positions on the arcuate receiving surface 1a on opposite sides of the axis of the coupler 6. Thus, even in positions of the holding members $H_1$ and $H_2$ relatively rotated further through 180 degree from their states shown in FIG. 6, the inner surface of the fastening 7' can be brought into engagement with the other locking projection 8' to prevent the holding members $H_1$ and $H_2$ from being rotated. Even in this embodiment, an effect similar to that in the previous embodiments can be provided.

Alternatively, in the fourth embodiment, two sets of lock mechanisms L' may be provided, as the lock mechanisms L in the first embodiment. Even only one set of the lock mechanism is provided in the fourth embodiment, the locking projection 8' may be, of course, formed also on the holding member $H_2$ having the fastening mounted thereon, as in the second embodiment.

What is claimed is:

1. A clamp fitment for connecting pipe sections, comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein each of the holding members includes a base frame having an arcuate receiving surface capable of abutting against an outer peripheral surface of said pipe section, said base frames being placed on each other and coupled by said coupler, said lock mechanism being comprised of a fastening rotatably supported on one of said base frames, and an engage recess formed on said receiving surface of the other base frame such that a locking piece provided at a free end of said fastening can be engaged into and disengaged from said engage recess.

2. A clamp fitment for connecting pipe sections according to claim 1, wherein said fastening and said engage recess are provided for each of the holding members.

3. A clamp fitment for connecting pipe sections according to claim 1, wherein said fastening is provided only for one of the holding members.

4. A clamp fitment for connecting pipe sections according to claim 3, wherein said engage recess is omitted from the holding member having said fastening mounted thereon.

5. A clamp fitment for connecting pipe sections, comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein in a condition in which said pipe sections are not mounted, said lock mechanism is movable between an engaged position in which the relative rotation of both said holding members is restrained, and a disengaged position in which said restraint is released, and in a condition in which said pipe sections have been mounted, the movement of said lock mechanism located in the engaged position toward the disengaged position is inhibited.

6. A clamp fitment for connecting pipe sections, comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein each of the holding members includes a base frame having an arcuate receiving surface capable of abutting against an outer peripheral surface of said pipe section, said base frames being placed on each other and coupled by said coupler, said lock mechanism being comprised of a frame-type fastening rotatably supported on one of said base frames, and a locking projection formed on said receiving surface of the other base frame such that said locking projection can be brought into engagement with an inner surface of a closed free end of said fastening.

7. A clamp fitment for connecting pipe sections, comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein said lock mechanism comprises an engaging means provided on one of said holding members and an engaged means provided on the other of the holding members, said engaging means coming into engagement with said engaged means when the holding members are at such relative positions that the pipe sections to be clamped by the holding members intersect each other at right angles, said engaging means being not capable of engaging with said engaged means when the intersection between the pipe sections are at any angle other than the right angles.

8. A clamp fitment for connecting pipe sections, comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein each of the holding members includes a base frame having an arcuate receiving surface capable of abutting against an outer peripheral surface of said pipe section, said base frames being placed on each other and coupled by said coupler, said lock mechanism being comprised of a fastening rotatably supported on one of said base frames, and an engage recess formed on said receiving surface of the other base frame such that a locking piece provided at a free end of said fastening can be engaged into and disengaged from said engage recess.

9. A clamp fitment for connecting pipe sections according to claim 8, wherein said fastening and said engage recess are provided for each of the holding members.

10. A clamp fitment for connecting pipe sections according to claim 8, wherein said fastening is provided only for one of the holding members.

11. A clamp fitment for connecting pipe sections according to claim 10, wherein said engage recess is omitted for the holding member having said fastening mounted thereon.

12. A clamp fitment for connecting pipe sections comprising a pair of holding members each capable of clamping one of said pipe sections, a coupler mounted between both said holding members for relatively rotatably but unseparatably coupling said holding members, and a lock mechanism mounted between both said holding members for restraining the relative rotation of said holding members at any time in positions in which said pipe sections to be clamped in said holding members intersect each other at right angles;

wherein each of the holding members includes a base frame having an arcuate receiving surface capable of abutting against an outer peripheral surface of said pipe section, said base frames being placed on each other and coupled by said coupler, said lock mechanism being comprised of a frame-type fastening rotatably supported on one of said base frames, and a locking projection formed on said receiving surface of the other base frame such that said locking projection can be brought into engagement with an inner surface of a closed free end of said fastening.

* * * * *